US005582144A

United States Patent [19]

Mizutani

[11] Patent Number: 5,582,144

[45] Date of Patent: Dec. 10, 1996

[54] DRY CYLINDER LINER FOR INTERNAL COMBUSTION ENGINES

[75] Inventor: Kazunori Mizutani, Okaya, Japan

[73] Assignee: Teikoku Piston Ring Co., Ltd., Tokyo, Japan

[21] Appl. No.: 575,330

[22] Filed: Dec. 20, 1995

[30] Foreign Application Priority Data

Dec. 22, 1994 [JP] Japan ..... 6-336266

[51] Int. Cl.[6] ..... F02F 1/08

[52] U.S. Cl. ..... 123/193.2

[58] Field of Search ..... 123/193.2, 193.3; 29/888.06, 888.061

[56] References Cited

U.S. PATENT DOCUMENTS

| | | | |
|---|---|---|---|
| 3,620,137 | 11/1971 | Prasse | 123/193.2 |
| 4,791,891 | 12/1988 | Kubis et al. | 123/193.2 |
| 5,148,780 | 9/1992 | Urano et al. | 123/193.2 |
| 5,408,964 | 4/1995 | Rao | 123/193.2 |

FOREIGN PATENT DOCUMENTS

| | | |
|---|---|---|
| 6-82466 | 11/1994 | Japan . |
| 935370 | 8/1963 | United Kingdom . |
| 1538357 | 1/1979 | United Kingdom . |
| 1551533 | 8/1979 | United Kingdom . |

*Primary Examiner*—Marguerite McMahon
*Attorney, Agent, or Firm*—Armstrong, Westerman, Hattori, McLeland & Naughton

[57] ABSTRACT

A dry cylinder liner has a flange at the outer circumference of the upper part of a liner barrel, and also has a grind relief groove formed below the flange at the outer circumferential surface of the liner barrel. The upper surface and the lower surface of the flange are coated with a coating film comprising a heat resistant resin containing a solid lubricant. The coating film may also be applied to only the lower surface of the liner flange. This coating film may also be applied to the upper surface of a cylinder block that contacts the lower surface of the liner flange.

8 Claims, 4 Drawing Sheets

DRY CYLINDER LINER FOR INTERNAL COMBUSTION ENGINES

BACKGROUND OF THE INVENTION

1. Field of the Invention

This invention relates to a dry cylinder liner for use in internal combustion engines such as a diesel engine.

2. Description of the Related Art

In diesel engines a dry liner is used in which the liner barrel does not make direct contact with the cooling water. In the most common dry liner, a flange is provided on the upper outer circumference in an axial direction and a grind relief groove is provided below the flange at the outer circumferential surface of the liner barrel. The dry liner is inserted into the cylinder bore of the cylinder block and the flange is fastened along with the gasket, between the lower surface of the cylinder head and the upper surface of the cylinder block by tightening of the head bolts.

However, in recent years demand has steadily mounted for thin-walled dry liners in order to make the engine lighter and more compact. One critical problem that must be dealt with to meet this demand is reduction of tensile stress on the inner circumferential surface of the liner at the grind relief groove below the flange caused by repetitive stress induced by combustion pressure and piston slap during engine operation.

The loose-fit type of the dry liner, which has a gap between the inner circumferential surface of the bore of the cylinder block and the outer circumferential surface of the liner, has the advantage that assembly and maintenance are easy, and no machining of the inner circumferential surface of the liner is needed after assembly. This advantage has caused the loose-fit type liner to see frequent use. During operation of an engine with this type of liner, the liner expands from heat due to a temperature difference between the liner and the cylinder block, so that the outer circumferential surface of the liner barrel makes direct contact with the inner circumferential surface of the bore of the cylinder block. However, this liner also has the disadvantage in that when the liner temperature is low, a gap is present between the liner barrel and the bore of the cylinder block, making the liner barrel prone to deformation.

The tight-fit type of the dry liner has no gap between the outer circumferential surface of the liner and the inner circumferential surface of the bore of the cylinder block and press-fit is carried out during assembly. However in the tight-fit type of the liner, a gap appears just as with the loose-fit type liner when deformation occurs in the cylinder block or the liner in the vicinity of the grind relief groove.

As prior technology for reducing tensile stress on the liner inner circumferential surface at the grind relief groove below the flange, there is for instance a proposal to provide partly press-fit portions below the grind relief groove (see Japanese Utility Model Laid-open No. 6-82466). However changing partly the dimension of the liner barrel is difficult for using conventional centerless grinding.

SUMMARY OF THE INVENTION

It is an object of this invention to reduce the tensile stress applied to the liner inner circumferential surface at the grind relief groove below the flange due to combustion pressure or piston slap. It is the further object of this invention to achieve the above mentioned objective without modification of the liner thickness, liner material or shape of the liner grind relief groove.

This invention is a dry liner for internal combustion engines having a flange on the outer circumference of a liner barrel, said liner barrel being inserted into the bore of a cylinder block, said flange being fastened between a cylinder head and said cylinder block. A coating film comprising a heat resistant resin containing a solid lubricant is provided between the lower surface of said flange and the upper surface of said cylinder block.

The coating film can be coated on the lower surface of the liner flange, or the upper surface of the cylinder block in contact with the lower surface of the liner flange, or both surfaces.

The coating film comprising a heat resistant resin containing a solid lubricant is preferably applied also to the upper surface of the liner flange.

This invention is particularly effective when a gap is present between the outer circumferential surface of the liner barrel and the inner circumferential surface of the bore of the cylinder block.

In the above, the thickness of the coating film is within a range of 2 to 10 μm and more preferably within a range of 3 to 5 μm.

The heat resistant resin may for instance use polyimide resin or fluorocarbon resin.

The solid lubricant may for instance use one type, or two or more types of molybdenum disulfide or graphite etc.

Repetitive deformation occurs radially inwardly and outwardly in the liner barrel and flange due to combustion pressure, heat expansion, or piston slap. The liner barrel stiffness is small compared to the flange and when a gap is present between the cylinder block and the liner barrel, the liner barrel is subject to larger deformation compared to the flange.

In this invention however, a coating film comprising a heat resistant resin containing a solid lubricant is present between the lower surface of the liner flange and the upper surface of the cylinder block, so that the friction force between the flange and the cylinder block is small and the flange is easily prone to deformation compared to the conventional dry liner. For this reason, the relative deformation between the liner barrel and the flange is smaller and the tensile stress applied to the liner inner circumferential surface at the grind relief groove below the flange is reduced.

The lower surface of the liner flange contacts the upper surface of the high rigidity cylinder block, while the upper surface of the liner flange contacts the lower surface of the gasket which has low rigidity. Therefore, the constraining force acting on the lower surface of the flange is greater than the constraining force acting on the upper surface of the flange. A coating film on the lower surface of the flange is sufficient for achieving the objects of this invention, however a coating film also applied to the upper surface can provide even greater results.

BRIEF DESCRIPTION OF THE DRAWINGS

The aforesaid and other objects and features of the present invention will become more apparent from the following detailed description and the accompanying drawings.

DESCRIPTION OF THE PREFERRED EMBODIMENTS

Figure 1:
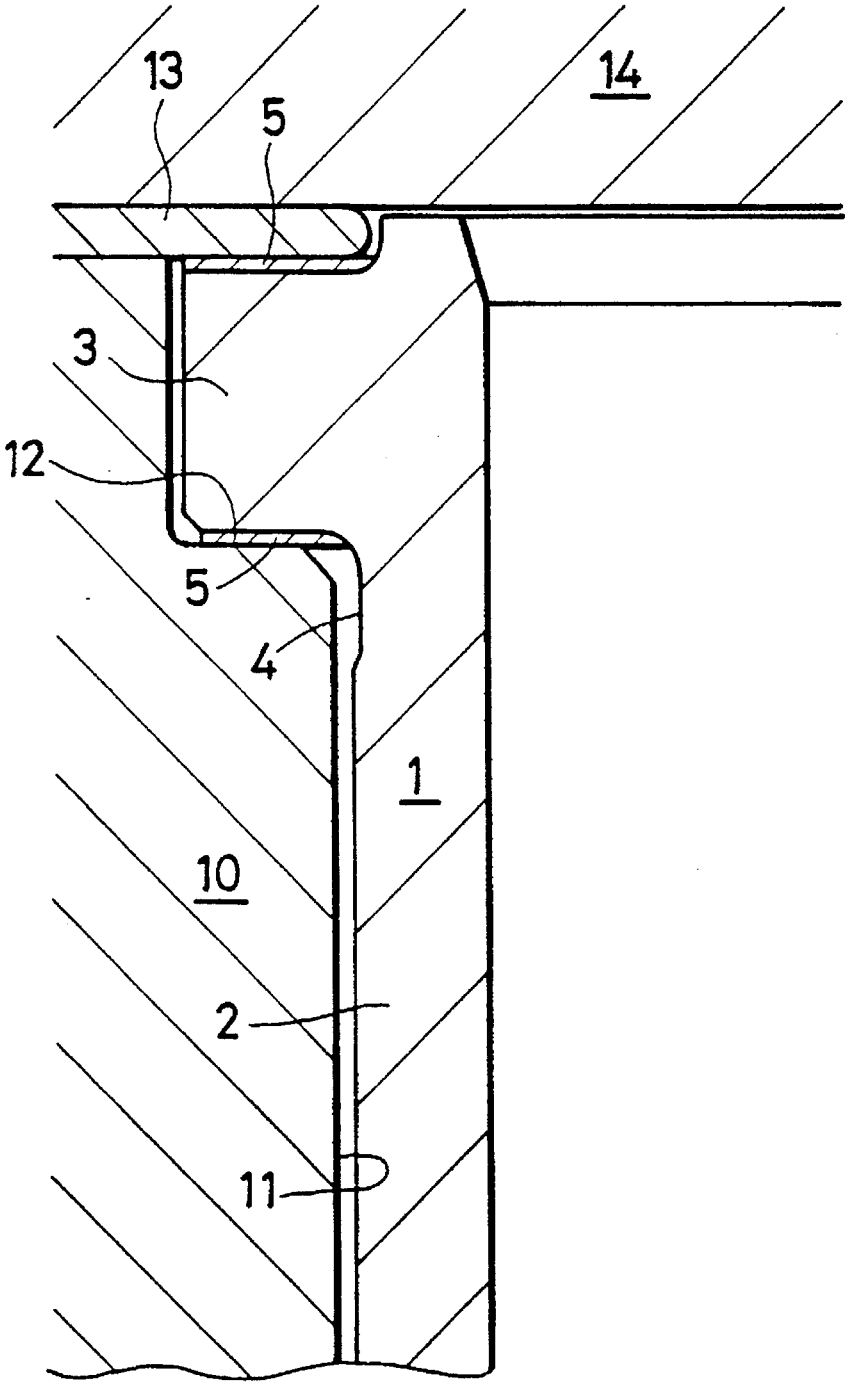
FIG. 1 is is a longitudinal cross sectional view showing a part of the engine having a cylinder block with the dry liner of one preferred embodiment of this invention.

FIG. 1 is a longitudinal cross sectional view showing a part of the engine having a cylinder block with a dry liner of one preferred embodiment of this invention. A dry liner i is provided with a flange 3 at the outer circumference of the upper part of a liner barrel 2. A grind relief groove 4 is formed below the flange 3 at the outer circumferential surface of the liner barrel 2. A 5 μm thick coating film 5 comprising a heat resistant resin containing a solid lubricant is coated on the upper surface and the lower surface of the flange 3 of the dry liner 1 of this embodiment.

With the dry liner 1 inserted in a bore 11 of a cylinder block 10 and the flange 3 mounted on a step portion 12 formed at the upper end of the bore 11, the flange 3 is fastened along with a gasket 13 in between the lower surface of a cylinder head 14 and the upper surface of the cylinder block 10 by means of the head bolts.

The outer diameter of the liner barrel 2 of the dry liner 1 is formed smaller than the inner diameter of the bore 11 of the cylinder block 10, so that with the dry liner 1 mounted in the cylinder block 10, a gap is present between the outer circumferential surface of the liner barrel 2 of the dry liner 1 and the inner circumferential surface of the bore 11 of the cylinder block 10.

Figure 2:
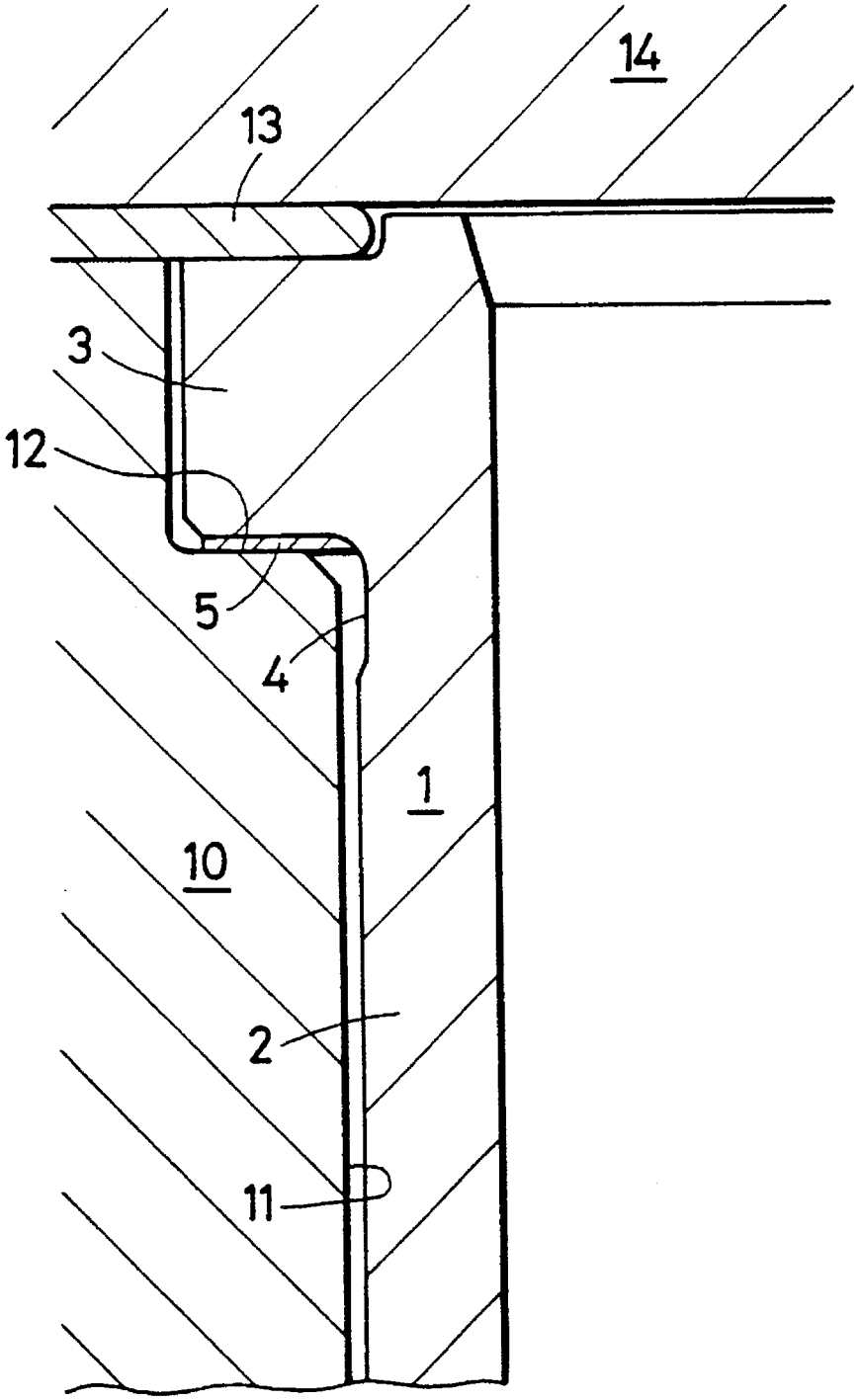
FIG. 2 is a longitudinal cross sectional view showing a part of the engine having a cylinder block with the dry liner of another embodiment of this invention.

FIG. 2 is a longitudinal cross sectional view showing a part of the engine having a cylinder block with a dry liner of another embodiment of this invention. A dry liner 1 of this embodiment differs from the previous embodiment in that a coating film 5 is formed at different portions. Namely, in this embodiment, the 5 μm thick coating film 5 is coated on the lower surface of the flange 3 of the dry liner 1, with no coating of coating film on the upper surface of the flange 3. The coating film comprising a heat resistant resin containing a solid lubricant is preferably coated on the upper and lower surfaces of the flange 3 as was related previously, however, a coating on only the lower surface of the flange 3 is sufficient to attain the objects of this invention.

Manufacturing the dry liner of this embodiment is merely a matter of masking other than necessary portions after forming the liner in normal manner, applying the coating material of heat resistant resin containing solid lubricant to the necessary portions and then drying. Defriccoat (HMB2) by Kawamura Laboratory or equivalent materials may for instance be used as the coating material of heat resistant resin containing solid lubricant.

Next the effect of this invention is explained from measurement results of the deformation of the flange and the liner barrel of the dry liner during engine operation and results of stress analysis of the liner inner circumferential surface at the grind relief groove below the flange. The stress was analyzed by means of the finite element method using the deformation results.

The engine on which dry liner deformation measurements were performed was an in-line six cylinder diesel engine with an exhaust displacement of 9.2 1.

The dry liner used was as follows.

Material: cast iron for cylinder liner equivalent to JIS FC 250

Inner diameter: 120 mm

Gap between the inner circumferential surface of the bore of the cylinder block and the outer circumferential surface of the liner barrel: 100 μm (diameter difference)

The dry liner of this embodiment is covered on the upper and lower surfaces of the flange with a 5 μm thick coating film comprising a heat resistant resin containing a solid lubricant. The dry liner of the comparative example was not covered on the upper and lower surfaces of the flange with a coating film comprising a heat resistant resin containing a solid lubricant.

Measurement of liner deformation was performed as follows.

Figure 3:
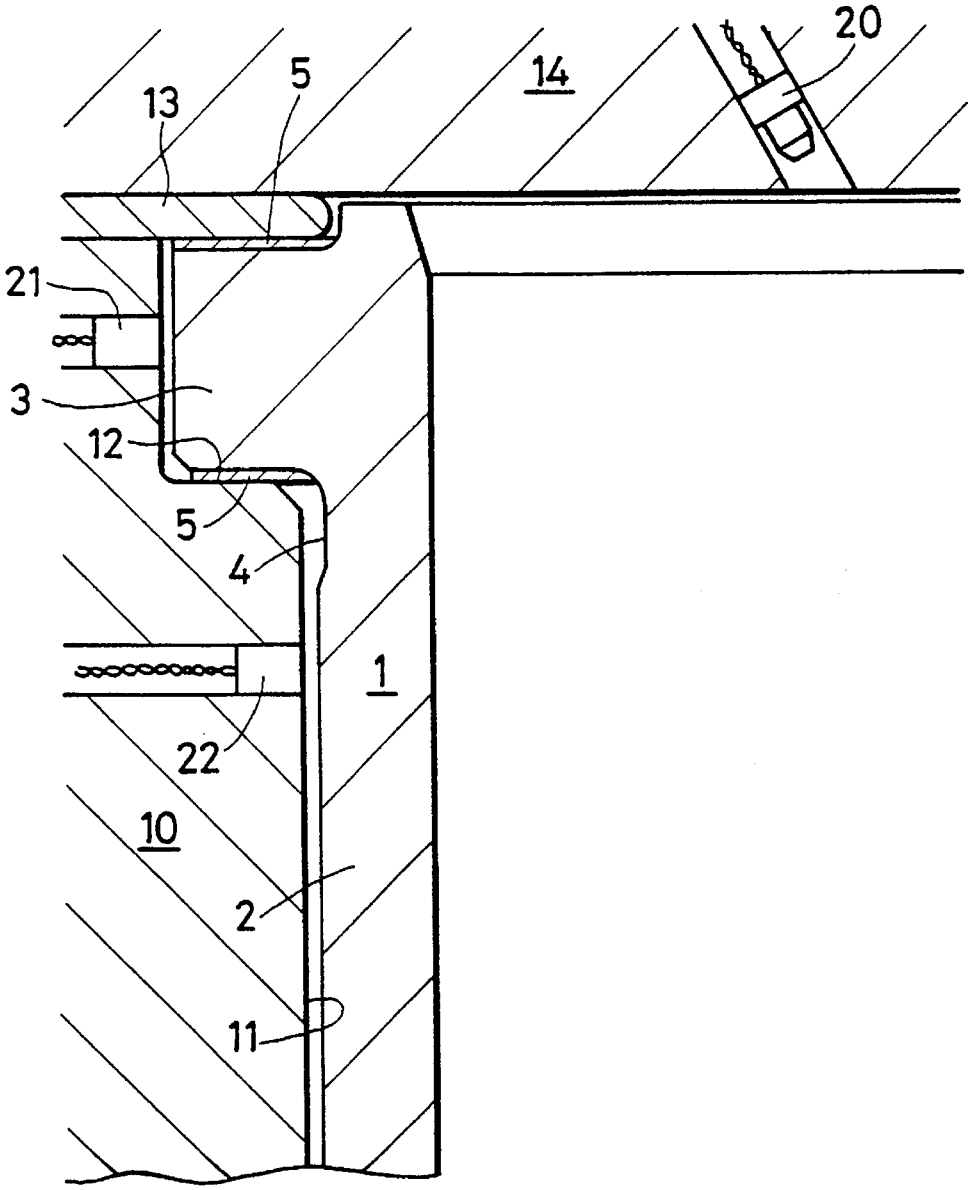
FIG. 3 is a longitudinal cross sectional view showing sensor placement positions for measuring deformation of the liner in the engine.

Pressure sensors and displacement sensors were embedded in the positions shown in FIG. 3 (FIG. 3 shows the liner of the embodiment) in each of the dry liners. A pressure sensor 20 is embedded on the head side of the combustion chamber and displacement sensors 21 and 22 using the eddy current method were so embedded that their surfaces are aligned with the inner circumferential surface of the bore of the cylinder block. The embedded position of the displacement sensor 21 for measuring the flange deformation was a position 4 mm below the head surface. The embedded position of the displacement sensor 22 for measuring the liner barrel deformation was a position 40 mm below the head surface.

Measurement was performed by running the engine under the following conditions and synchronizing the signals from the pressure sensor 20 and the displacement sensors 21 and 22.

Coolant temperature: 20° C., 90° C.

Engine speed: 1000 rpm, 2000 rpm

Load: No load, medium load, high load

Data obtained from each of the displacement sensors 21 and 22 show the respective gaps between the inner circumferential surface of the bore 11 of the cylinder block 10 and the outer circumferential surface of the liner barrel 2 of the dry liner 1, as well as the outer circumferential surface of the flange 3 of the dry liner 1. The gap data obtained shows that each gap becomes smaller as the pressure rises and grows larger as the pressure lowers. The gap variation of the liner barrel 2 is larger than the variation of the flange 3. With no deformation in the cylinder block 10 (no variation in absolute position of the displacement sensors 21 and 22), then the above gap data can be treated as typical liner deformation data.

Table 1 shows the gap for the embodiment and the comparative example, amount of relative deformation of the liner barrel relative to the flange, and stress analysis values of the liner inner circumferential surface at the grind relief groove. The stress was analyzed by means of the finite element method using the amount of flange and liner barrel deformation. Relative deformation amount of the liner barrel relative to the flange was used as boundary conditions.

The measured data and analysis show that tensile stress on the liner inner circumferential surface at the grind relief groove has been drastically reduced in this invention. Further, since the cast iron for cylinder liner has a fatigue limit of approximately 20 kgf/mm$^2$, it is apparent that the dry liner of this embodiment is sufficient for strength.

TABLE 1

| Item | | | Embodiment | Comparative Example |
|---|---|---|---|---|
| Gap between cylinder block and liner prior to tightening of head bolts μm | Flange | A | 30 | 30 |
| | Liner barrel | a | 46 | 46 |
| Gap between cylinder block and liner during engine operation μm | Flange | B | 8.1~7.1 | 28.5~27.5 |
| | Liner barrel | b | 17.2~6.2 | 22.0~0 |
| Liner barrel deformation VS flange [2m | a − b − A + B | | 6.9~16.9 | 22.5~43.5 |
| Tensile stress on liner inner circumferential surface at grind relief groove when above deformation is applied to liner barrel relative to flange. $kgf/mm^2$ | | | 9.5~12.0 | 15.5~30.0 |

Figure 4:
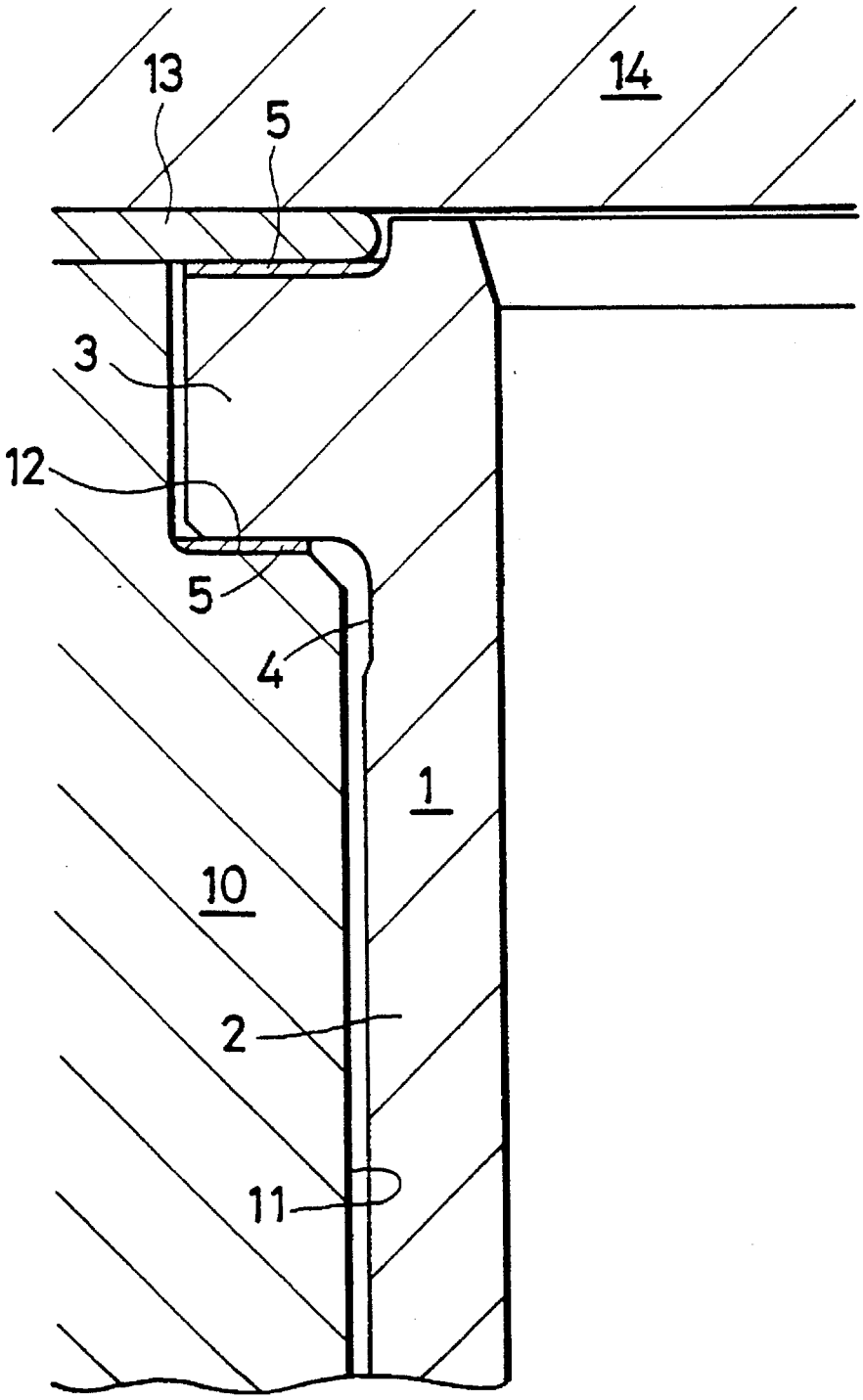
FIG. 4 is a longitudinal cross sectional view showing a part of the engine having a cylinder block with the dry liner of another embodiment of this invention.

FIG. 4 is a longitudinal cross sectional view showing a part of the engine having a cylinder block with a dry liner of another embodiment of this invention. This embodiment has the coating film formed at a position different from the previous two embodiments. More specifically, in this embodiment, a 5 μm thick coating film 5 is formed on the upper surface of the step portion 12 of the cylinder block 10 on which the lower surface of the flange 3 of the dry liner 1 is mounted. The upper surface of the flange 3 of the dry liner 1 is coated with the 5 μm thick coating film 5, while the lower surface of the flange 3 is not coated with the coating film. In this embodiment, the lower surface of the flange 3 of the dry liner 1 may be coated with the coating film. Also, the upper surface of the flange 3 is not necessarily coated with the coating film but a coating at this position is desirable.

What is claimed is:

1. A dry liner for internal combustion engines having a flange at the outer circumference of a liner barrel, said liner barrel being inserted into the bore of a cylinder block, said flange being fastened between a cylinder head and said cylinder block, wherein a coating film comprising a heat resistant resin containing a solid lubricant is provided between the lower surface of said flange and the upper surface of said cylinder block.

2. A dry liner for internal combustion engines as claimed in claim 1, in which said coating film covers the lower surface of the flange of said liner.

3. A dry liner for internal combustion engines claimed in claim 1, in which said coating film covers the upper surface of said cylinder block in contact with the lower surface of the flange of said liner.

4. A dry liner for internal combustion engines as claimed in claim 1, in which said coating film covers the lower surface of the flange of said liner, and the upper surface of said cylinder block in contact with the lower surface of the flange of said liner.

5. A dry liner for internal combustion engines as claimed in claim 1, in which a coating film comprising a heat resistant resin containing a solid lubricant covers the upper surface of the flange of said liner.

6. A dry liner for internal combustion engines as claimed in claim 1, in which a gap is present between the barrel of said liner and the bore of said cylinder block.

7. A dry liner for internal combustion engines as claimed in claim 1, in which said coating film has a thickness of 2 to 10 μm.

8. A dry liner for internal combustion engines as claimed in claim 1, in which said heat resistant resin is of polyimide resin or fluorocarbon resin and said solid lubricant is at least one of molybdenum disulfide and graphite.

* * * * *